US007766187B2

(12) United States Patent
Schaefers

(10) Patent No.: US 7,766,187 B2
(45) Date of Patent: Aug. 3, 2010

(54) NAPKIN DISPENSER

(75) Inventor: James A. Schaefers, 6293 Misty Pines Ct., Unit 3, Tinley Park, IL (US) 60477

(73) Assignee: James A. Schaefers, Tinley Park, IL (US)

( * ) Notice: Subject to any disclaimer, the term of this patent is extended or adjusted under 35 U.S.C. 154(b) by 803 days.

(21) Appl. No.: 11/513,533

(22) Filed: Aug. 31, 2006

(65) Prior Publication Data

US 2008/0067186 A1 Mar. 20, 2008

(51) Int. Cl.
*B65H 1/08* (2006.01)

(52) U.S. Cl. ..... 221/54; 221/47; 221/48; 221/52; 221/53; 221/56; 221/63

(58) Field of Classification Search ..... 221/1–312 C, 221/52, 54, 56, 47, 48, 53
See application file for complete search history.

(56) References Cited

U.S. PATENT DOCUMENTS

| | | | | |
|---|---|---|---|---|
| 815,337 | A | 3/1906 | Ellis | |
| 1,128,566 | A | 2/1915 | Yearicks | |
| 1,186,705 | A | 6/1916 | Swift | |
| 1,209,317 | A | 12/1916 | Marcuse | |
| 1,216,713 | A | 2/1917 | Marcuse | |
| 1,692,463 | A | 11/1928 | Merrin | |
| 1,703,594 | A | 2/1929 | Pratt | |
| 1,719,690 | A | 7/1929 | Coons | |
| 1,874,642 | A * | 8/1932 | Shaffer et al. | 221/47 |
| 1,989,381 | A | 1/1935 | Samson | |
| 2,027,668 | A | 1/1936 | Broeren | |
| 2,211,284 | A | 8/1940 | Miller | |
| 3,095,996 | A | 7/1963 | Babin | |
| 3,749,281 | A * | 7/1973 | Stovers et al. | 221/298 |
| 4,473,172 | A * | 9/1984 | Reynolds | 221/213 |
| 5,332,117 | A | 7/1994 | Yadegar | |
| 5,642,836 | A | 7/1997 | Merriweather, Jr. | |
| 6,241,118 | B1 | 6/2001 | Tramontina | |
| D445,003 | S | 7/2001 | Tramontina | |
| D445,651 | S | 7/2001 | Tramontina | |
| D445,652 | S | 7/2001 | Tramontina | |
| D446,086 | S | 8/2001 | Tramontina | |
| D448,252 | S | 9/2001 | Tramontina et al. | |
| D449,496 | S | 10/2001 | Tramontina | |
| D450,542 | S | 11/2001 | Tramontina | |
| D451,349 | S | 12/2001 | Tramontina et al. | |
| D451,770 | S | 12/2001 | Tramontina | |
| 6,334,544 | B1 | 1/2002 | Christensen et al. | |

(Continued)

*Primary Examiner*—Gene Crawford
*Assistant Examiner*—Michael K Collins
(74) *Attorney, Agent, or Firm*—Carmen Patti Law Group, LLC

(57) ABSTRACT

A napkin dispenser with a springless means for urging napkins therein toward an opening in the front face of the dispenser. The front face has two side edges with each side edge connected a side wall of the dispenser and each side wall has at least one inclined guide that is sloped downwardly toward the front face. The means for urging napkins comprises a generally vertical plate having at least one nub on each side edge, with each nub associated with an inclined guide of one of the side walls, so that the plate urges the napkins disposed in the structure to move toward the opening in the front face through which the napkins can be withdrawn from the napkin dispenser independent of a spring.

4 Claims, 3 Drawing Sheets

U.S. PATENT DOCUMENTS

| | | | | |
|---|---|---|---|---|
| D455,615 | S | 4/2002 | Tramontina | |
| 6,419,113 | B1 | 7/2002 | Tramontina | |
| 6,422,416 | B1 | 7/2002 | Tramontina | |
| 6,752,290 | B2 | 6/2004 | Tramontina | |
| 6,830,151 | B2 | 12/2004 | Spencer et al. | |
| 7,341,166 | B2 * | 3/2008 | Reinsel et al. | 221/59 |

* cited by examiner

NAPKIN DISPENSER

BACKGROUND OF THE INVENTION

Napkin dispensers are ubiquitous in restaurants, ice cream parlors, fast food drive-ins and coffee shops throughout the world. They generally consist of a container with a front opening through which the napkins can be removed. To keep a diminishing supply of napkins in the container positioned at the front opening, a spring biased panel with a spring disposed between the back wall of the container and the panel is generally employed. One of the problems with using a spring biasing system is the lack of uniform pressure applied to the panel throughout the range of use. When the dispenser is full, too much pressure can impede the removal of napkins from the dispenser, resulting in tearing napkins and the need to remove excess napkins to compensate for the torn ones. Also, when the dispenser is near empty, too little pressure is applied to the remaining napkins to allow just one napkin to be removed at a time, resulting in excess napkins being removed.

To alleviate this problem, and others which will become apparent from the disclosure which follows, the present invention conveniently offers a springless system with one-at-a-time dispensing, easy loading, high capacity, and reduced consumption and waste. This invention teaches a napkin dispenser with a springless means for urging napkins therein toward an opening in the front face of the dispenser. The front face has two side edges with each side edge connected a side wall of the dispenser and each side wall has at least one inclined guide that is sloped downwardly toward the front face. The means for urging napkins comprises a generally vertical plate having at least one nub on each side edge, with each nub associated with an inclined guide of one of the side walls, so that the plate urges the napkins disposed in the structure to move toward the opening in the front face through which the napkins can be withdrawn from the napkin dispenser independent of a spring.

ADVANTAGES OF THIS INVENTION

The improved napkin dispenser utilizes a variety of inclined guides to move a weighted vertical plate forward to exert consistent pressure on the napkins in the dispenser. In one embodiment the inclined guides comprises simple elongated slots in the side wall of the dispenser. In another embodiment, the inclined guides comprise a top edge of each of the side walls, and in another embodiment, tracks are disposed on inside surfaces of the side walls to receive the nubs protruding from the side edges of the plate. This simple and effective plate moving occurs between an upper napkin full position to a lower napkin emptying position and moves the napkins toward the front face without use of springs.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Still other advantages will be apparent from the disclosure that follows.

SUMMARY OF THE INVENTION

According to one aspect of the invention, a napkin dispenser comprising a structure for holding napkins and a means for urging napkins in the structure toward an opening in the front face of the structure is disclosed. The front face has two side edges with each side edge connected to the front edge one of a first side wall and a second side wall of the structure. Each of the first side wall and second side wall has at least one inclined guide, and each of the at least one inclined guide is sloped downwardly toward the front face.

The means for urging napkins in the structure toward the opening in the front face of the structure comprises a plate disposed between the first side wall and the second side wall of the structure. The plate has a first side edge and a second side edge with the first side edge proximate to the first side wall and the second side edge proximate to the second side wall. The first side edge has at least one protuberance corresponding in number to the number of the at least one inclined guide of the first side wall, and the second side edge has at least one protuberance corresponding in number to the number of the at least one inclined guide of the second side wall. Each of the at least one protuberance is operably connected to one of the at least one inclined guide, so that the plate urges the napkins disposed in the structure to move toward the opening in the front face through which the napkins can be withdrawn from the napkin dispenser independent of a spring.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWING

Embodiments of the invention are illustrated by way of example, and not by way of limitation, in the figures of the accompanying drawings and in which like reference numerals refer to similar elements and in which.

DETAILED DESCRIPTION OF THE INVENTION

Figure 1:
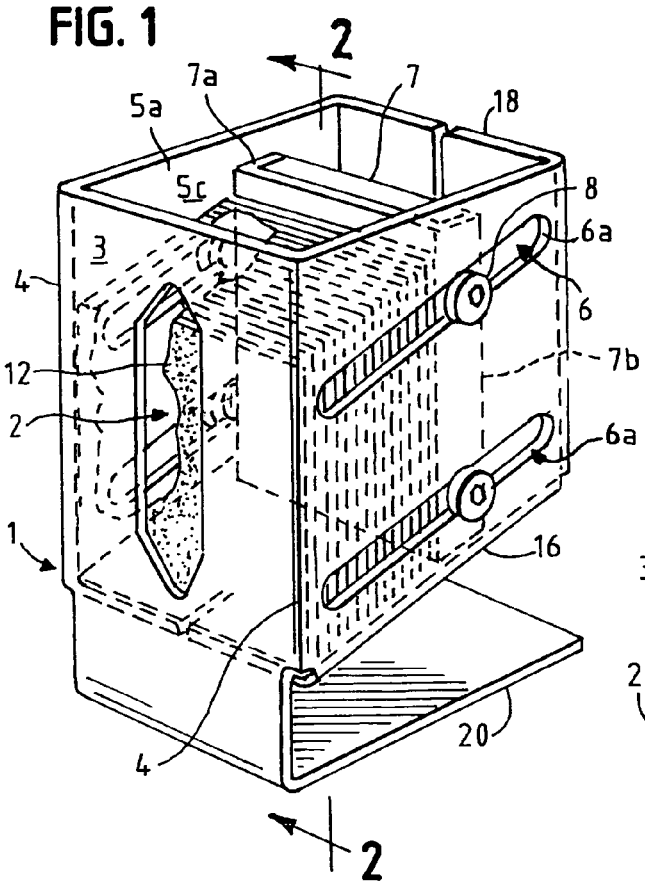
FIG. 1 is a perspective view of the napkin dispenser of the present invention showing a multitude of napkins disposed within a uniques structure of the dispenser with each of the side walls having two inclined guides for one of a plurality of rotating nubs extending from to the side edges of a plate for moving the napkins toward the opening of the front face of the structure and a sloped bottom wall upon which the napkins are supported.

In the following description, specific details are set forth in order to provide a thorough understanding of the invention. However, it will be apparent that the invention may be practiced without these specific details.

Without departing from the generality of the invention disclosed herein and without limiting the scope of the invention, the discussion that follows, will refer to the invention as depicted in the drawing.

According to one embodiment, a napkin dispenser comprising a structure 1 for holding napkins and means for urging napkins in the structure toward the opening 2 in the front face 3 of the structure. The dispenser has an opening 2, through which napkins disposed in the structure 1 can be withdrawn, in a front face of the structure 1. The front face has two side edges 4 with each side edge connected to the front edge one of a first side wall 5*a* and a second side wall 5*b* of the structure. Each of the first side wall 5*a* and second side wall 5*b* has at least one inclined guide 6, and each of the at least one inclined guide is sloped downwardly toward the front face 3.

Referring to FIG. 1, the means for urging napkins in the structure 1 toward the opening 2 in the front face 3 of the structure 1 comprises a plate 7 disposed between the first side wall 5*a* and the second side wall 5*b* of the structure. The plate has a first side edge 7*a* and a second side edge 7*b* with the first side edge 7*a* proximate to the first side wall 5*a* and the second side edge 7*b* proximate to the second side wall 5*b*. The first side edge has at least one protuberance 8 corresponding in number to the number of the at least one inclined guide 6 of the first side wall 5*a*, and the second side edge 7*b* has at least one protuberance 8 corresponding in number to the number of the at least one inclined guide 6 of the second side wall 5*b*. Each of the at least one protuberance 8 is operably connected to one of the at least one inclined guide 6, so that the plate 7 urges the napkins 12 disposed in the structure 1 to move toward the opening in the front face through which the napkins can be withdrawn from the napkin dispenser independent of a spring.

Figure 2:
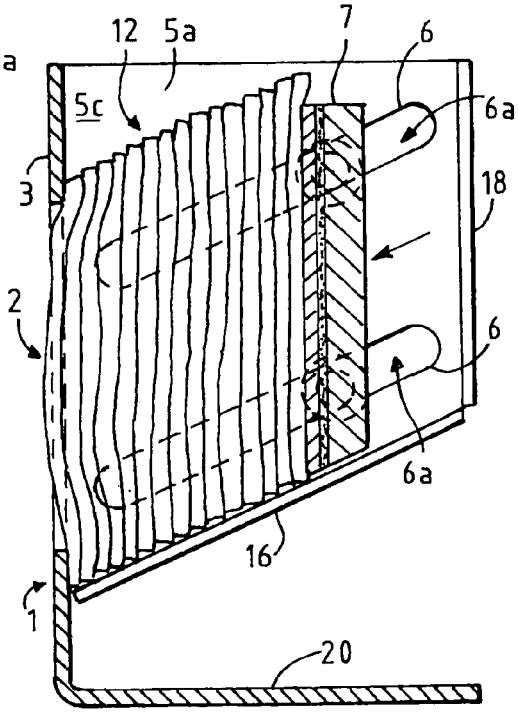
FIG. 2 is a cross sectional view of the napkin dispenser taken along the lines of 2-2 of FIG. 1.

Preferably, the plate 7 of the napkin dispenser is sufficiently weighted so that it urges that napkins 12 toward the front face 3 throughout its entire traverse along the inclined guide without the use of a spring. As best shown in FIG. 2, the thickness of plate 7 is preferably uniform throughout its length and width.

Figure 3:
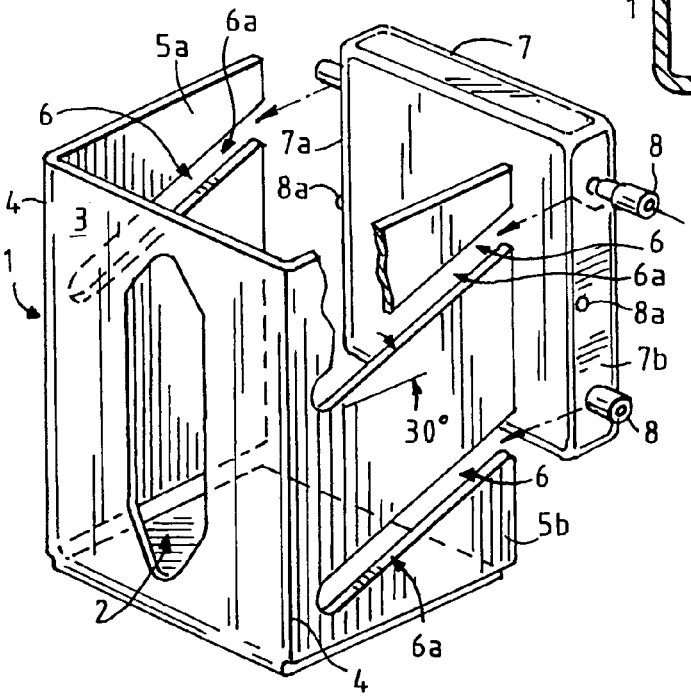
FIG. 3 is a perspective view of one embodiment of the napkin dispenser showing a structure which may be independent of a stationary rear wall.
Figure 6:
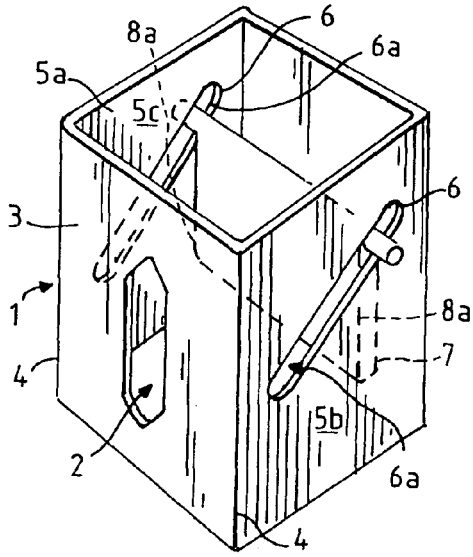
FIG. 6 is an illustration of one embodiment of the napkin dispenser showing the protuberances extending from the side edge and proximate the top edge of the plate and with each said protuberance being disposed in an inclined slot in one of the side walls.
Figure 10:
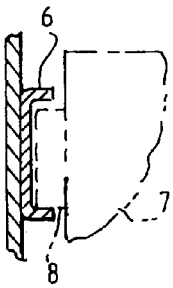
FIG. 10 is a fragmentary sectional view taken along the line 10-10 of FIG. 9 showing the track attached to the side wall and in phantom further showing a protuberance extending from the plate which is received by the track.
Figure 12:
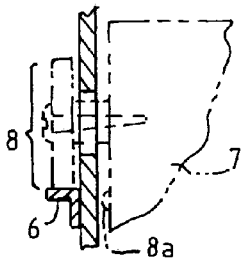
FIG. 12 is a fragmentary sectional view taken along line 12-12 of FIG. 11 showing a guide nub for facilitating movement of the plate.

Each protuberance 8 may be rotatingly attached to the plate as shown in FIGS. 1, 5 and 7-8. Preferably, each protuberance is stationary and integrally attached to the plate as shown in FIGS. 3, 6 and 10.

Each of the at least one inclined guide 6 of the napkin dispenser, in embodiments having a non-rotating protuberance, has an angle that is at least 30° from horizontal. In embodiments having a rotating protuberance, the angle from horizontal may generally be in the range of about 15° to about 60°. Each of the at least one inclined guide of the napkin dispenser has an angle that is preferably 30° from horizontal. Furthermore, the angle of the each of the at least one inclined guide may be uniform.

Figure 9:
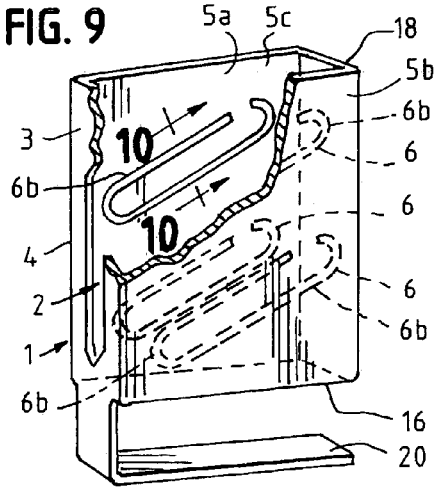
FIG. 9 is a cut away perspective view of one embodiment of the napkin dispenser showing two uniformly spaced incline guides on the first wall and two uniformly spaced incline guides on the second side wall for receiving uniformly spaced protuberances on each side of the plate, each of said incline guides being an elongated track attached to an interior surface of one of the side walls of the structure, said elongated track being suitably sized to receive one of the at least one protuberance of the plate.
Figure 11:
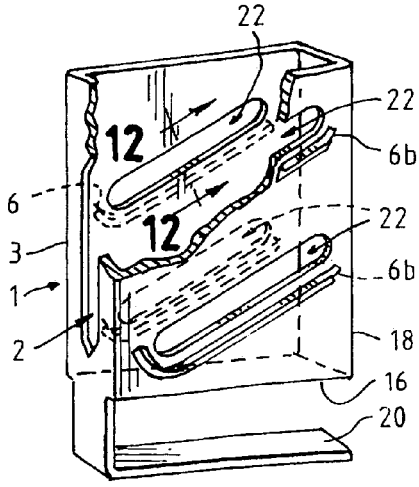
FIG. 11 is a cut away perspective view of an embodiment of the invention.

In an embodiment of the napkin dispenser of this important invention, the at least one inclined guide associated with each of the first side wall and second side wall comprises two uniformly spaced inclined guides, and the at least one protuberance associated with each of the first side edge and the second side edge comprises two uniformly spaced protuberances corresponding in spacing to the spacing of the two uniformly spaced inclined guides. See, for example, FIGS. 1, 3 and 9. The two uniformly spaced protuberances 8 of the first side edge 7*a* can be operably associated with the two uniformly spaced inclined guides 6 of the first side wall 5*a*, and the two uniformly spaced protuberances 8 of the second side edge 7*b* can be operably associated with the two uniformly spaced inclined guides 6 of the second side wall 5*b* to urge napkins 12 disposed in the structure 1 in front of the plate 7 to be moved toward the front face 3 while maintaining the plate in a generally vertical position, as shown in FIG. 2. A guide nub 8*a* can be provided on one or both side edges 7*a*, 7*b* to facilitate movement of plate 7 toward the front face 3.

As shown in FIGS. 1-6 and 10, the at least one inclined guide 6 may comprise an elongated slot 6*a* in one of the first side wall 5*a* and the second side wall 5*b* that is suitably sized to receive one of the at least one protuberance 8 of the plate 7. In another embodiment of the at least one inclined guide 6 comprises an elongated track 6*b* attached to an interior surface 5*c* of the first side wall 5*a* and the second side wall 5*b* of the structure 1, the elongated track 6*b* is suitably sized to receive one of the at least one protuberance 8 of the plate 7. Referring to figures of the drawing, the plate 7 is supported in the structure 1 solely by the at least one protuberance 8 on each of the first side edge 7*a* and the second side edge 7*b*.

Figure 7:
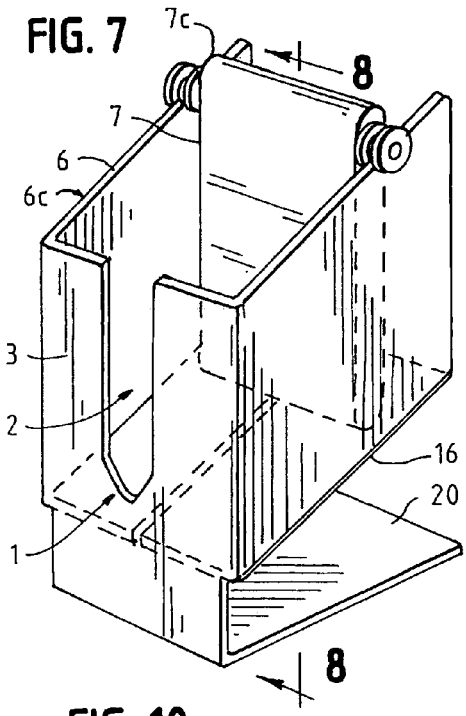
FIG. 7 is a perspective view of one embodiment of the napkin dispenser of the present invention showing the rotating protuberances extending from the side edges and proximate the top edge of the plate that is received by the inclined guides which comprise the top edges of the respective side walls.

In an embodiment of the napkin dispenser, the structure 1 may be independent of a stationary rear wall, as shown in FIGS. 3 and 7.

In one embodiment of the napkin dispenser, the structure 1 may be a closed structure with a top wall 14, a bottom wall 16, and a back (or rear) wall 18, with the side edges of the top wall is connected respectively to the top edges of the first side wall and the second side wall, the front edge of the top wall is connected to the top edge of the front wall, the back edge of the top wall is connected to the top edge of the back wall, the side edges of the bottom wall is connected respectively to the bottom edges of the first side wall and the second side wall, and the front edge of the bottom wall is connected to the bottom edge of the front wall, and the back edge of the bottom wall is connected to the bottom edge of the back wall. Additionally, the bottom wall 16 may be sloped downwardly, as shown in FIGS. 1-2 and 7-8, toward the front face 3 to further assist the movement of napkins 12 to the front opening 2.

Figure 4:
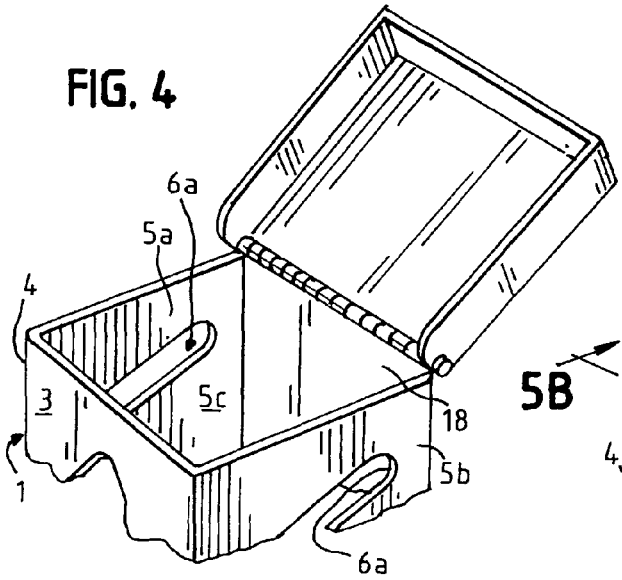
FIG. 4 is a fragmentary perspective view of one embodiment of the present invention showing a top wall hingedly connected to the structure.
Figure 5:
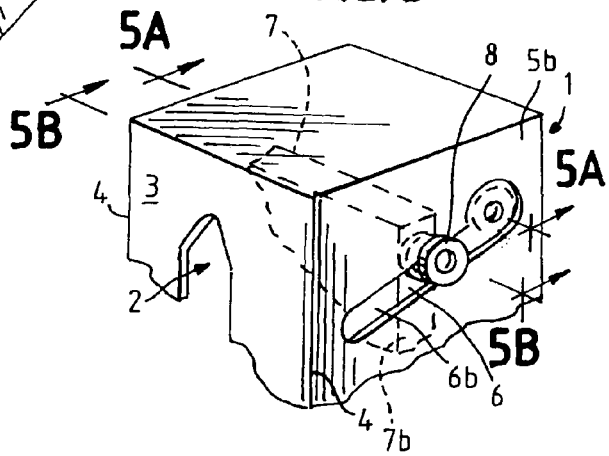
FIG. 5 is an illustration of one embodiment of the present invention showing a protuberance rotatingly attached to the plate and the inclined slot of the side wall being suitably sized at its higher end to accommodate the receipt of a rotating wheel of the protuberance.
Figure 5A:
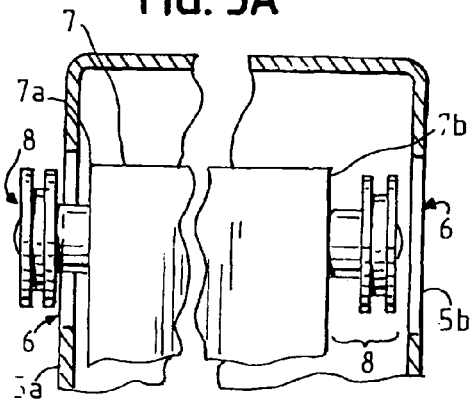
FIG. 5A is a fragmentary cross sectional view taken along the line of 5A-5A of FIG. 5 showing one of the protuberances of the plate projecting through a side wall while the plate is being installed on the structure.
Figure 5B:
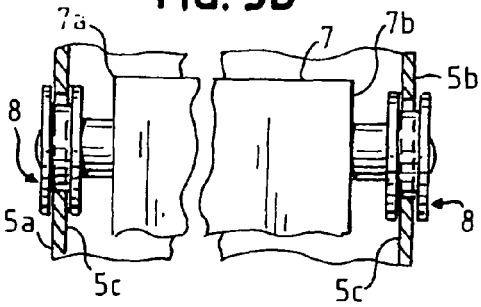
FIG. 5B is a fragmentary cross section view taken along the line of 5B-5B of FIG. 5 showing the plate installed with the rotating protuberance disposed within the slot and further showing the rotating element each having a flange which engages the side wall to keep the plate from becoming skewed.

In another embodiment of the napkin dispenser of the present invention, the structure 1 has a top wall 14, a bottom wall 16, and a back wall 18, with the side edges of the top wall respectively extending over the top edges of the first side wall and the second side wall, the front edge of the top wall extending over the top edge of the front wall, the back edge of the top wall 14 is pivotably connected to the top edge of the back wall, as shown in FIG. 4, the side edges of the bottom wall is connected respectively to the bottom edges of the first side wall and the second side wall, and the front edge of the bottom wall is connected to the bottom edge of the front wall, and the back edge of the bottom wall is connected to the bottom edge of the back wall. Again, the bottom wall may be sloped downwardly toward the front face as best shown in FIG. 2.

A preferred embodiment of the napkin dispenser comprises a structure 1 for holding napkins 12 with an opening 2, through which napkins disposed in the structure can be withdrawn, in a front face 3 of the structure. The structure also has a top wall 14, a bottom wall 16, a base wall 20, and a back wall 18. The front face 3 has two side edges 4 with each side edge is connected to the front edge one of a first side wall 5*a* and a second side wall 5*b* of the structure. Each of the first side wall and second side wall has at least one inclined guide 6; each of the at least one inclined guide 6 is sloped downwardly toward the front face 3; the side edges of the top wall 14 respectively extending over the top edges of the first side wall and the second side wall; the front edge of the top wall extending over the top edge of the front wall; the back edge of the top wall is pivotably connected to the top edge of the back wall; the side edges of the bottom wall is connected respectively to the bottom edges of the first side wall and the second side wall; the front edge of the bottom wall is connected to the front wall at a spaced distance from the bottom edge of the front wall; and the back edge of the bottom wall is connected to the bottom edge of the back wall. The bottom wall 16 is sloped downwardly toward the front face, and the base wall 20 is disposed horizontally and the front edge of the base wall is connected to the bottom edge of the front wall.

Means for urging napkins in the structure 1 toward the opening in the front face of the structure are provided. The means for urging comprise a plate 7 disposed between the first side wall 5*a* and the second side wall 5*b* of the structure. The plate has a first side edge 7*a* and a second side edge 7*b* with the first side edge 7*a* being proximate to the first side wall 5*a* and the second side edge 7*b* being proximate to the second side wall 5*b*. The first side edge 7*a* has at least one protuberance 8 corresponding in number to the number of the at least one inclined guide 6 of the first side wall 5*a*. The second side edge 7*b* has at least one protuberance 8 corresponding in number to the number of the at least one inclined guide 6 of the second side wall 5*b*, and each of the at least one protuberance 8 is operably connected to one of the at least one inclined guide 6, so that the plate 7 urges the napkins 12 disposed in the structure 1 with the sloped bottom wall 16 to move toward the opening 2 in the front face 3 through which the napkins can be withdrawn from the napkin dispenser independent of a spring, and the dispenser is supported uprightly by the horizontal base wall 20.

Preferably, the slope of the bottom wall 16 is substantially the same as the slope of the at least one inclined guide 6 of each of the first and second side walls (5*a* and 5*b*).

Furthermore, the at least one inclined guide 6 associated with each of the first side wall and second side wall comprises two uniformly spaced inclined guides, and the at least one protuberance associated with each of the first side edge and the second side edge comprises two uniformly spaced protuberances corresponding in spacing to the spacing of the two uniformly spaced inclined guides. Whereby, the two uniformly spaced protuberances 8 of the first side edge 7*a* can be operably associated with the two uniformly spaced inclined guides 6 of the first side wall 5*a*, and the two uniformly spaced protuberances 8 of the second side edge 7*b* can be operably associated with the two uniformly spaced inclined guides 6 of the second side wall 5*b* to urge napkins 12 disposed in the structure 1 in front of the plate 7 to be moved toward the front face 3 while maintaining the plate in a generally vertical position.

In addition, the plate 7 may be sufficiently weighted so that it urges the napkins 12 toward the front face 3 throughout its entire traverse along the inclined guide 6, with each protuberance 8 being stationary and integrally attached to the plate 7 and the thickness of plate being uniform throughout its length and width and the angle of the each of the at least one inclined guide is preferably 30° from horizontal. The structure of the dispenser may be made of any suitable manufacturing process and material, including steel, alloys and plastics. The plate can comprise steel, iron, an alloy or other suitable weighty material.

Figure 8:
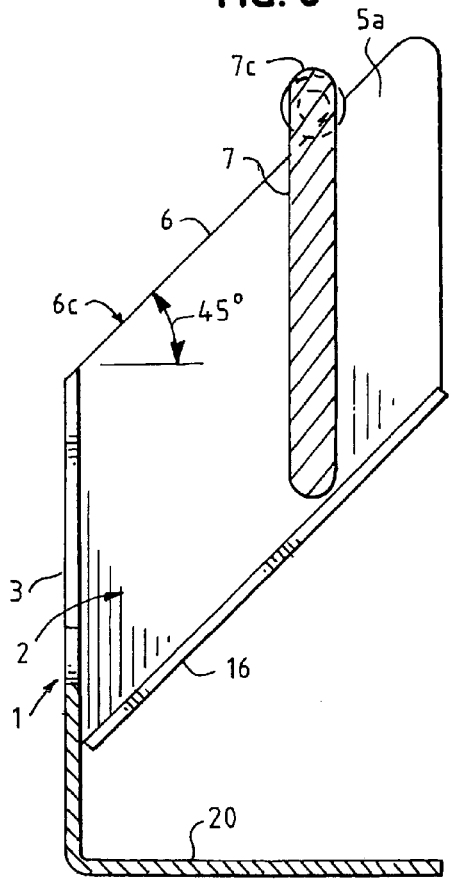
FIG. 8 is a cross sectional view taken along the lines 8-8 of FIG. 7 showing the rotating protuberance of the plate resting on the top inclined edge of the side walls and further showing the sloped bottom wall of the dispenser.

In another embodiment of the napkin dispenser, a structure 1 for holding napkins 12 with an opening 2, through which napkins disposed in the structure can be withdrawn, in a front face 3 of the structure is taught. The front face has two side edges 4 with each side edge being connected to the front edge one of a first side wall and a second side wall of the structure. Each of said first side wall 5*a* and second side wall 5*b* has an inclined upper edge 6*c* as shown in FIGS. 7 and 8, and each of said inclined upper edges is sloped downwardly toward the front face 3. Means for urging napkins in the structure toward the opening in the front face of the structure 1 is also taught. The means for urging comprises a plate 7 disposed generally between the first side wall 5*a* and the second side wall 5*b* of the structure 1. The plate has a top edge 7*c*, a first side edge 7*a*, and a second side edge 7*b* with the first side edge being proximate to the first side wall and the second side edge being proximate to the second side wall. The first side edge 7*a* has one lateral protuberance 8 proximate the top edge 7*c* of the plate, and the second side edge 7*b* has one lateral protuberance 8 proximate the top edge 7*c* of the plate 7. Each of the lateral protuberances is operably connected to one of the inclined upper edges 6*c*. In this way, the plate 7 urges the napkins 12 disposed in the structure 1 to move toward the opening 2 in the front face 3 through which the napkins can be withdrawn from the napkin dispenser independent of a spring.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

My invention resides not in any one of these features per se, but rather in the particular combinations of some or all of them herein disclosed and claimed and it is distinguished from the prior art in these particular combinations of some or all of its structures for the functions specified.

With respect to the above description then, it is to be realized that the optimum dimensional relationships for the parts of the invention, including variations in size, materials, shape, form, function and manner of operation, assembly and use, and all equivalent relationships to those illustrated in the drawings and described in the specification, that would be deemed readily apparent and obvious to one skilled in the art, are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A napkin dispenser comprising:

a. a structure for holding napkins with an opening, through which napkins disposed in the structure can be withdrawn, in a front face of the structure, a top wall, a bottom wall, a base wall, and a back wall, i. said front face having two side edges with each side edge being connected to the front edge one of a first side wall and a second side wall of the structure, ii. each of said first side wall and second side wall having at least one inclined guide, iii. each of said at least one inclined guide being sloped downwardly toward the front face, iv. the side edges of the top wall respectively extending over the top edges of the first side wall and the second side wall, v. the front edge of the top wall extending over the top edge of the front wall, vi. the back edge of the top wall being pivotably connected to the top edge of the back wall, vii. the side edges of the bottom wall being connected respectively to the bottom edges of the first side wall and the second side wall, viii. the front edge of the bottom wall being connected to the front wall at a spaced distance from the bottom edge of the front wall, and ix. the back edge of the bottom wall being connected to the bottom edge of the back wall, x. said bottom wall being sloped downwardly toward the front face, xi. the base wall being disposed horizontally and the front edge of the base wall being connected to the bottom edge of the front wall; and b. means for urging napkins in the structure toward the opening in the front face of the structure, i. said means for urging comprising a plate disposed between the first side wall and the second side wall of the structure, (1) said plate having a first side edge and a second side edge with the first side edge being proximate to the first side wall and the second side edge being proximate to the second side wall, (2) the first side edge having at least one protuberance disposed substantially perpendicular to the at least one inclined guide corresponding in number to the number of the at least one inclined guide of the first side wall, (3) the second side edge having at least one protuberance disposed substantially perpendicular to the at least one inclined guide corresponding in number to the number of the at least one inclined guide of the second side wall, and (4) each of said at least one protuberance being operably connected to one of the at least one inclined guide, whereby, the plate urges the napkins disposed in the structure with the sloped bottom wall to move toward the opening in the front face through which the napkins can be withdrawn from the napkin dispenser independent of a spring, and the dispenser is supported uprightly by the horizontal base wall.

2. The napkin dispenser of claim 1, wherein the slope of the bottom wall is substantially the same as the slope of the at least one inclined guide of each of the first and second side walls.

3. The napkin dispenser of claim 1, wherein the at least one inclined guide associated with each of said first side wall and second side wall comprises two uniformly spaced inclined guides, and wherein the at least one protuberance associated with each of the first side edge and the second side edge comprises two uniformly spaced protuberances corresponding in spacing to the spacing of the two uniformly spaced inclined guides, whereby, the two uniformly spaced protuberances of the first side edge can be operably associated with the two uniformly spaced inclined guides of the first side wall, and the two uniformly spaced protuberances of the second side edge can be operably associated with the two uniformly spaced inclined guides of the second side wall to urge napkins disposed in the structure in front of the plate to be moved toward the front face while maintaining the plate in a generally vertical position.

4. The napkin dispenser of claim 3, wherein:

a. the plate is sufficiently weighted so that it urges that napkins toward the front face throughout its entire traverse along the inclined guide;

b. each protuberance is stationary and integrally attached to the plate;

c. the thickness of plate is uniform throughout its length and width; and d. the angle of the each of said at least one inclined guide is preferably 30 .degree. from horizontal.

* * * * *